US008023672B2

(12) United States Patent
Hsu

(10) Patent No.: US 8,023,672 B2
(45) Date of Patent: Sep. 20, 2011

(54) EASY-TO-ASSEMBLE ONE-PIECE SURROUND SPEAKER STRUCTURE

(75) Inventor: Wei Hsu, Taipei (TW)

(73) Assignee: Weistech Technology Co., Ltd., Taipei (TW)

( * ) Notice: Subject to any disclaimer, the term of this patent is extended or adjusted under 35 U.S.C. 154(b) by 839 days.

(21) Appl. No.: 12/061,731

(22) Filed: Apr. 3, 2008

(65) Prior Publication Data

US 2009/0046881 A1 Feb. 19, 2009

(30) Foreign Application Priority Data

Aug. 14, 2007 (TW) ..... 96213407 U

(51) Int. Cl.
*H04R 1/02* (2006.01)
*H04R 5/02* (2006.01)
*H04R 9/08* (2006.01)

(52) U.S. Cl. ..... 381/300; 381/386; 381/335

(58) Field of Classification Search ..... 381/300–303, 381/306, 332–333, 336, 345, 361–364, 386, 381/387, 388

See application file for complete search history.

(56) References Cited

U.S. PATENT DOCUMENTS 5,557,680 A * 9/1996 Janes ..... 381/27
6,459,799 B1 * 10/2002 Smits ..... 381/191
6,625,289 B1 * 9/2003 Oliemuller ..... 381/182
7,607,512 B2 * 10/2009 Harwood ..... 181/148
2005/0207603 A1 * 9/2005 Tse ..... 381/351

FOREIGN PATENT DOCUMENTS

JP 2007104195 A * 4/2007

OTHER PUBLICATIONS

U.S. Appl. No. 29/306,133, filed Apr. 3, 2008, Wei Hsu.

* cited by examiner

*Primary Examiner* — Anh Mai
(74) *Attorney, Agent, or Firm* — Ming Chow; Sinorica, LLC

(57) ABSTRACT

The present invention discloses an easy-to-assemble one-piece surround speaker structure, wherein a plurality of integrable speaker housings realizes a size-adjustable audio structure, and whereby an user can self-adjust the length of a surround speaker in accordance to the size of television or available space The speaker housings can contain various types of speakers, including: a main speaker, a center speaker, a surround speaker, a subwoofer speaker, etc. Thereby, an user can organize speakers to achieve the audio effect he desires. Each speaker has a plurality of I/O terminals for mutual signal and power connection. Thus, no matter what type of speaker combination is arranged or what number of speaker housings is integrated, the present invention can perform perfectly.

9 Claims, 6 Drawing Sheets

EASY-TO-ASSEMBLE ONE-PIECE SURROUND SPEAKER STRUCTURE

BACKGROUND OF THE INVENTION

1. Field of the Invention

The present invention relates to an easy-to-assemble one-piece surround speaker structure, particularly to a one-piece surround speaker structure, wherein an user can optionally arrange different numbers of speakers to build different-size audio systems.

2. Description of the Related Art

With the rising demand of standard of audio and video entertainment, more people want to possess a home theater—a miniature edition of a professional theater system, wherein the video display is upgraded, and it would be even better if there is a surround speaker system to go along with. Thus, surround speaker systems imitating a theater audio effect are persistently developed to satisfy these people's needs. The surround speaker systems currently sold in markets are usually of multi-part type. Thus, users have to arrange different audio units around their room to achieve a surround effect. Such a type of surround speaker system not only occupies considerable space but also troubles the user with the problem of cable connection. Each speaker needs individually wiring, which makes the installation of a surround speaker system expensive.

Recently, some technologies for one-piece surround speaker systems have been proposed, wherein the sound bounced from walls is used to realize the audio effect of the traditional multi-part surround speaker systems. However, the audio effect of the bounced sound varies with the dimensions of users' house. Besides, users cannot arrange speakers as they wishes because all speakers have been integrated into a single and fixed body. In addition, when an single speaker or the control unit of the surrounded speaker system fails, the entire audio system, including normal speakers, has to be carried to a maintenance center for repair, which brings many inconveniences to users.

In order to solve the abovementioned problems, the present invention proposes an easy-to-assemble surround speaker structure, wherein a design of assembly housings is used to assemble different types of speakers and control devices, and whereby an user can arrange various combinations of speakers to achieve audio effects he desires, and whereby the maintenance and repair of a surround speaker system is simplified which reduces the cost of maintenance and repair.

SUMMARY OF THE INVENTION

The primary objective of the present invention is to provide an easy-to-assemble one-piece surround speaker structure, wherein an user utilizes assembly housings to assemble different types of speakers and control devices to obtain one-piece surround speaker systems having different sizes and audio effects.

Another objective of the present invention is to provide an easy-to-assemble one-piece surround speaker structure, wherein an user can fast maintain/repair an audio system or replace speakers via a simple assemblage and disassemblage.

The easy-to-assemble one-piece surround speaker structure of the present invention comprises: a plurality of speakers providing different-quality sounds; a central control device receiving external audio signals and controlling the operations of the speakers; a control-device housing detachably accommodating the central control device and having a plurality of first speaker bays at the lower side thereof to accommodate the speakers; at least one speaker housing having at least one second speaker bay to detachably accommodate the speaker and having coupling mechanisms at two sides thereof to couple the speaker housing with other speaker housings or the control-device housing; and a speaker net wrapping the control-device housing and the speaker housings. The central control device further comprises: an audio input interface, a volume-control interface, a control unit, a plurality of output terminals and a power input terminal.

Below, the embodiments are described in detail in cooperation with the attached drawings to make easily understood the objectives, technical contents, characteristics and accomplishments of the present invention.

DETAILED DESCRIPTION OF THE INVENTION

The present invention proposes an easy-to-assemble one-piece surround speaker structure, wherein an user can determine the audio effect and appearance of an audio system via assembling different types of speakers and control devices, and wherein an user can maintain/repair an audio system or replace speakers via a simple assemblage and disassemblage.

Figure 1:
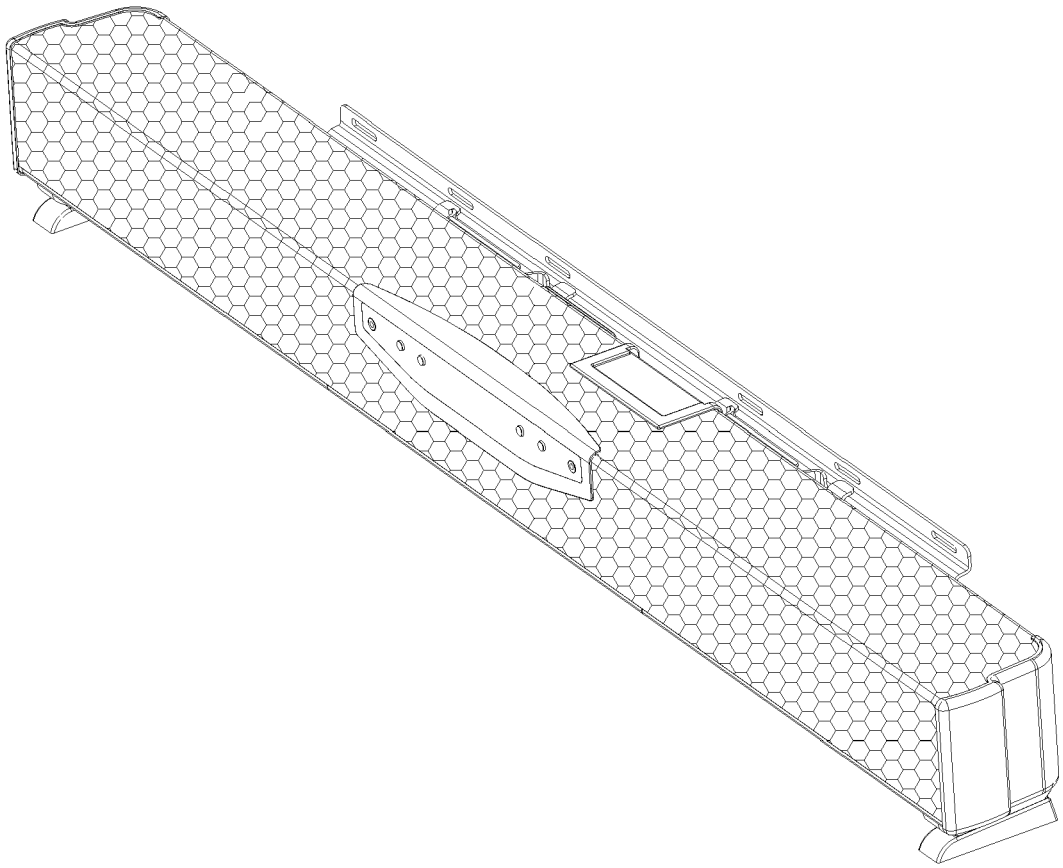
FIG. 1 is a perspective view schematically showing an easy-to-assemble one-piece surround speaker structure according to the present invention.
Figure 2:
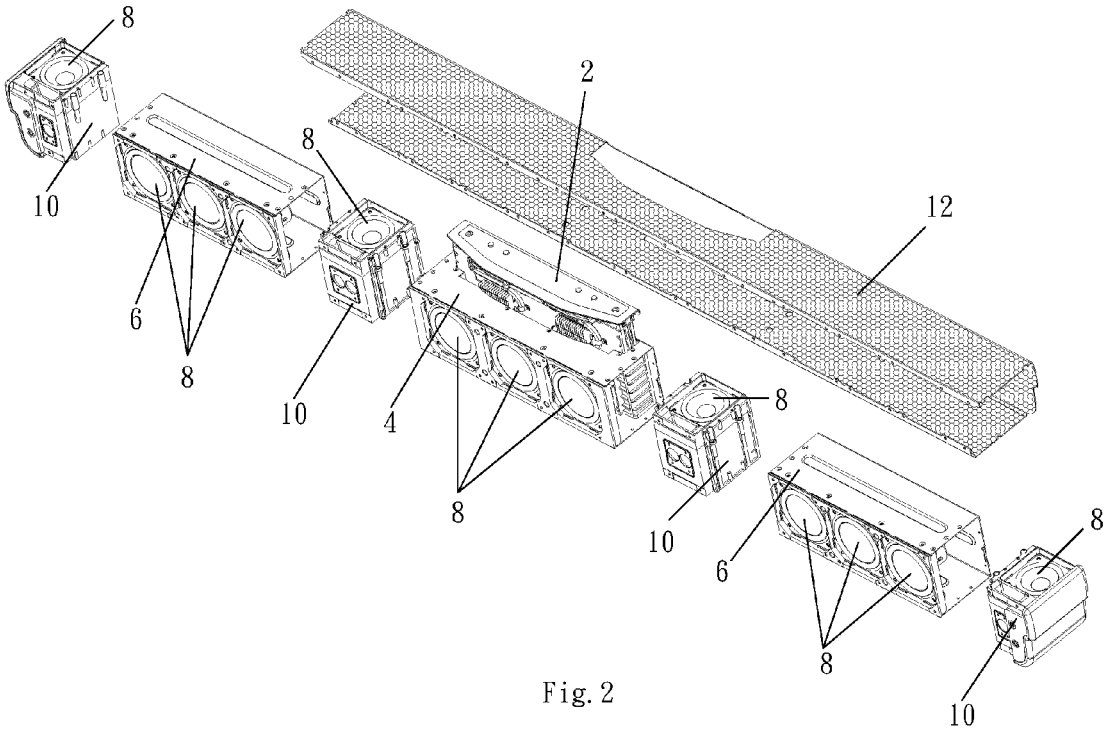
FIG. 2 is an exploded view schematically showing an easy-to-assemble one-piece surround speaker structure according to the present invention.

Refer to FIG. 1 a diagram schematically showing an audio system, which has been built with an easy-to-assemble one-piece surround speaker structure according to the present invention. The audio system can be placed on the top or bottom of a traditional television, a LCD television or a plasma television, etc., to collocate with the display or furniture thereof. Refer to FIG. 2, an exploded view schematically showing an easy-to-assemble one-piece surround speaker structure according to the present invention. The structure of the present invention comprises: a plurality of speakers and a central control device 2. The central control device 2 receives external audio signals and controls the operations of the speakers. The central control device 2 includes: an audio input interface receiving audio signals; a control unit processing audio signals and sending processed audio signals to corresponding speakers; a plurality of output terminals providing signal and power connection for the control unit and the speakers; and a power input terminal providing power for the abovementioned elements. The power input terminal has a fuse used to protect the central control device 2 from being damaged by an over current. The structure of the present invention also comprises: a control-device housing 4 used to accommodate the central control device 2, and a plurality of speak housings, such as multi-speaker housings 6 or single-speaker housing 10.

Figure 4:
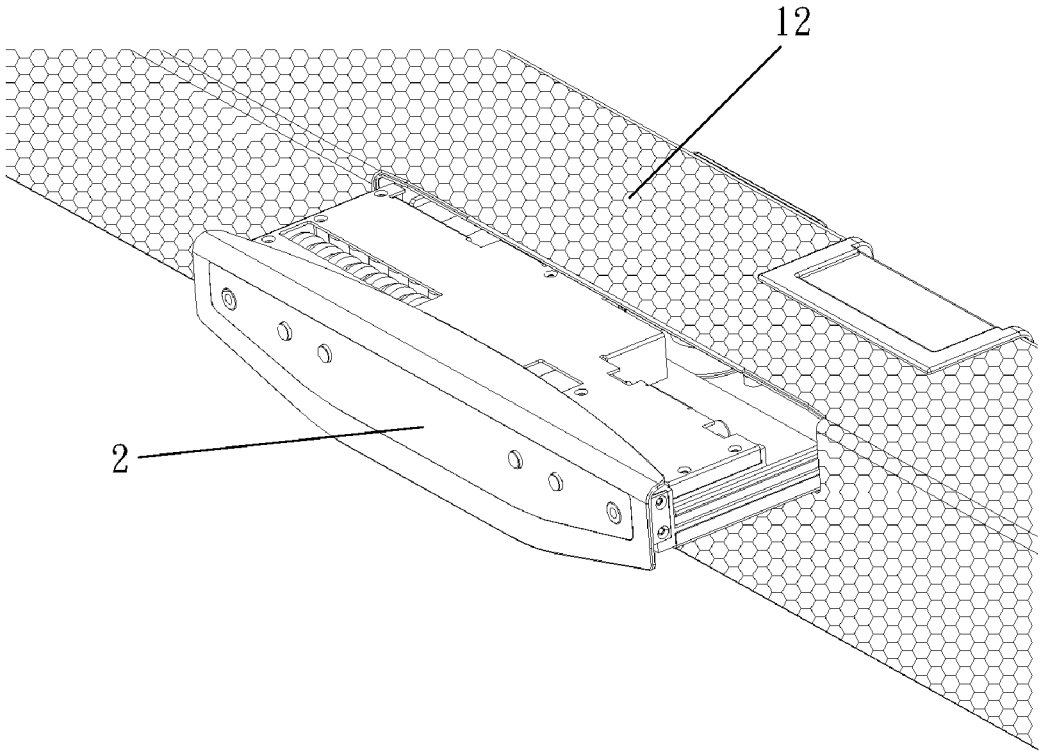
FIG. 4 is a diagram schematically showing that a central control device is detachably accommodated in a housing according to the present invention.

Refer to FIG. 4. As the central control device 2 usually has higher failure rate than other hardware devices, the control-device housing 4 is designed to detachably accommodates the central control device 2, which can make the maintenance and repair of the central control device 2 easier. The lower side of the control-device housing 4 has at least one first speaker bay to detachably accommodate speakers 8. The speak housings also have different numbers of second speaker bays according to their lengths, and the second speaker bays also detachably accommodate the speakers 8. In a preferred embodiment of the present invention, the multi-speaker housing 6 has three second speaker bays, and the single-speaker housing 10 has only one speaker bay. An user or a manufacturer may optionally select the speakers 8 accommodated in the first or second speaker bays, including: a main speaker, a center speaker, a surround speaker, a subwoofer speaker, etc.

Figure 3:
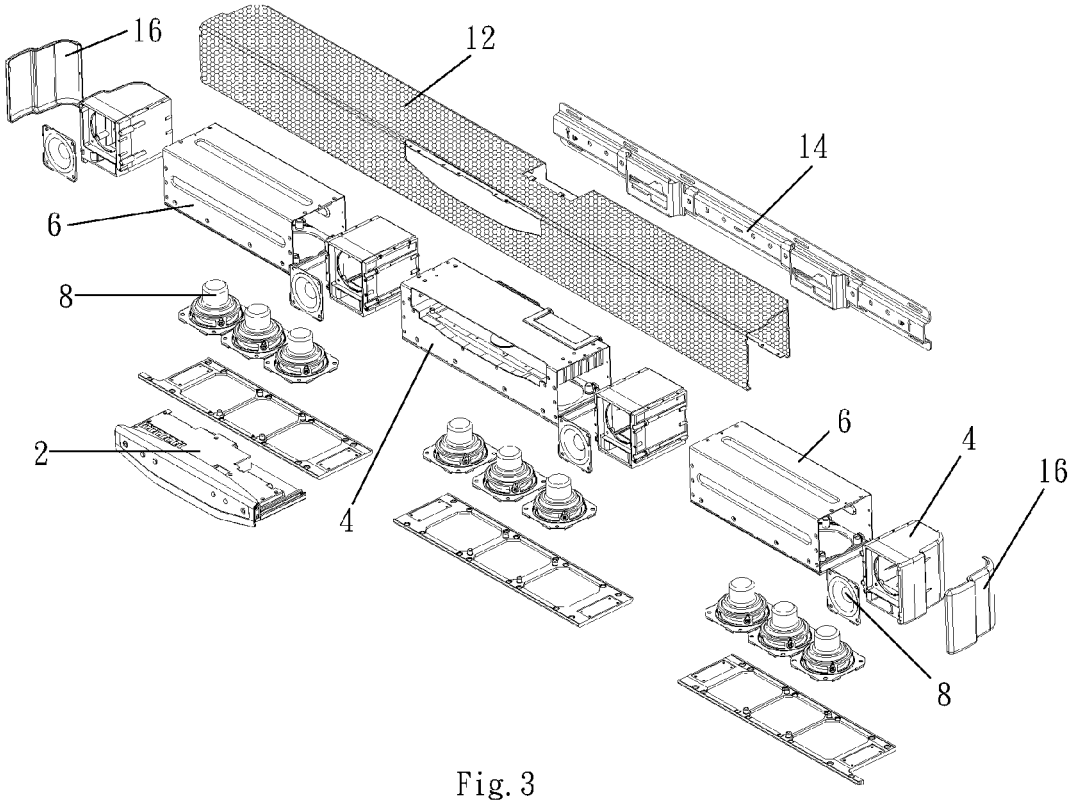
FIG. 3 is another exploded view schematically showing an easy-to-assemble one-piece surround speaker structure according to the present invention.

Refer to FIG. 3 a diagram schematically showing that the speakers 8 are detached from the control-device housing 4, the multi-speaker housings 6, and the single-speaker housing 10. Both sides of the speaker housings and the control-device housing 4 have coupling mechanisms for mutual coupling. Decoration covers 16 are used to decorate the housings arranged at the edges of the audio system. Each coupling mechanism has different cable holes, and signal cables and power cables of the speakers 8 can pass through the cable holes to connect with the central control device 2. The central control device 2 can distribute signals to each speaker 8 via the output terminals. The structure of the present invention further comprises a speaker net 12 used to warp the control-device housing 4 and the speaker housings. Different combinations make the easy-to-assemble one-piece surround speaker structure of the present invention have different lengths. Therefore, the speaker net 12 has different lengths, types and specifications to meet different combinations of speakers 8. All the speaker nets 12 have hooks 14 at the rear thereof. With the hooks 14, the easy-to-assemble one-piece surround speaker structure of the present invention can be hung on a plane, such as a wall.

Figure 5:
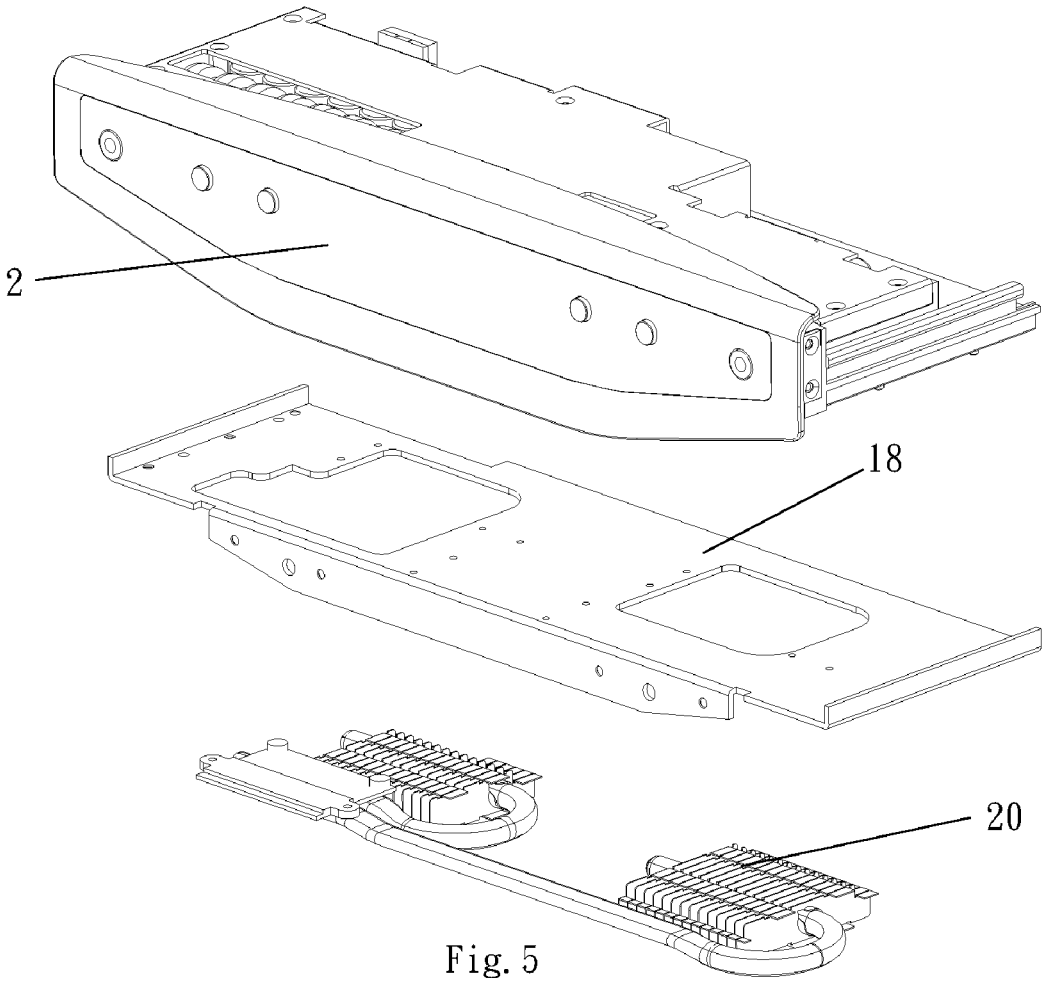
FIG. 5 is a diagram schematically showing a heat-dissipating structure for a central control device according to the present invention.
Figure 6:
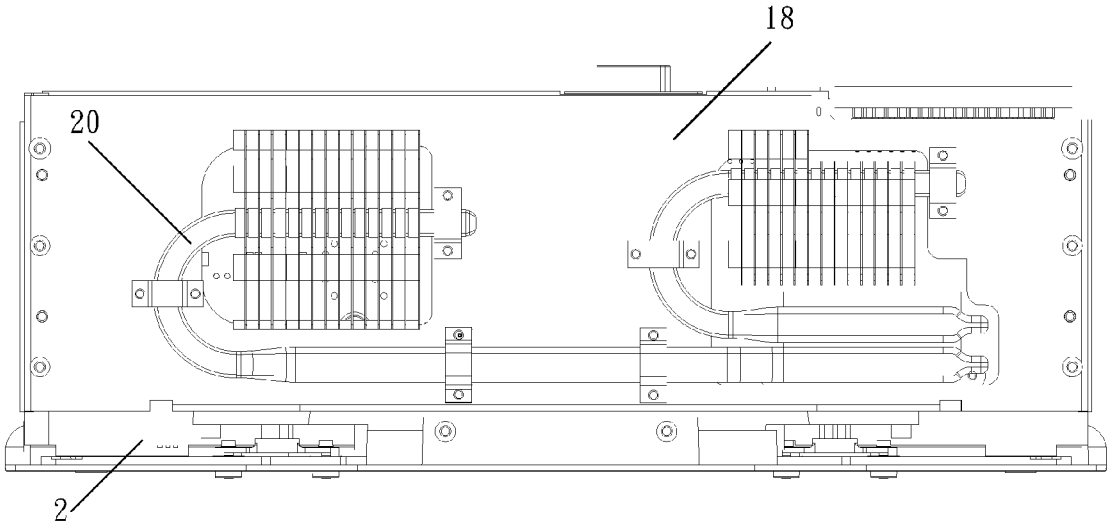
FIG. 6 is another diagram schematically showing a heat-dissipating structure for a central control device according to the present invention.

Refer to FIG. 5. The structure of the present invention further comprises a heat-dissipating board 18 and heat-dissipating fins 20, which are arranged below the central control device 2 lest over heating causes malfunction or damage. The large-area heat-dissipating board 18 and a multitude of dissipating fins 20 can remove the heat generated by the central control device 2 without using any electric fan. Refer to FIG. 6 a diagram schematically showing that the heat-dissipating board 18 and the dissipating fins 20 have been installed in below the central control device 2. Such an installation will not interfere with the detachment of the central control device 2 from the control-device housing 4. In the present invention, almost all the primary components can be detached from the housings via simple disassembling steps. Therefore, the present invention can overcome the disadvantages of the conventional one-piece surround speaker system and make maintenance or part replacement easier.

The embodiments described above are to demonstrate the technical thoughts and characteristics of the present invention to enable the persons skilled in the art to understand, make, and use the present invention. However, it is not intended to limit the scope of the present invention. Any equivalent modification or variation according to the spirit of the present invention is to be also included within the scope of the present invention.

What is claimed is:

1. An easy-to-assemble one-piece surround speaker structure comprising:

a plurality of speakers providing different-quality sounds;

a central control device receiving external audio signals, controlling operations of said speakers and further comprising:

an audio input interface receiving and transferring external audio signals;

a control unit processing said audio signals and sending processed audio signals to corresponding said speakers;

a plurality of output terminals providing signal and power connection for said control unit and said speakers; and a power input terminal providing power for abovementioned elements;

a control-device housing detachably accommodating said central control device and having a plurality of first speaker bays at a lower side thereof to accommodate said speakers;

at least one speaker housing having at least one second speaker bay to detachably accommodate said speaker and having coupling mechanisms at two sides thereof for mutually coupling with other said speaker housings or said control-device housing; and a speaker net wrapping said control-device housing and said speaker housings.

2. An easy-to-assemble one-piece surround speaker structure according to claim 1, wherein said speakers include: a main speaker, a center speaker, a surround speaker, a subwoofer speaker, etc.

3. An easy-to-assemble one-piece surround speaker structure according to claim 1, wherein said control-device housing also has said coupling mechanisms at two sides thereof.

4. An easy-to-assemble one-piece surround speaker structure according to claim 1, wherein said central control device sends audio signals to all said speakers inside said audio structure via said output terminals.

5. An easy-to-assemble one-piece surround speaker structure according to claim 1, wherein said central control device has a heat-dissipating board and heat-dissipating fins lest said central control device be overheated.

6. An easy-to-assemble one-piece surround speaker structure according to claim 1, wherein said speaker net has various types for user option.

7. An easy-to-assemble one-piece surround speaker structure according to claim 1, wherein said speaker net has hooks at a rear side thereof.

8. An easy-to-assemble one-piece surround speaker structure according to claim 7, wherein said audio structure is hung on a plane with said hooks.

9. An easy-to-assemble one-piece surround speaker structure according to claim 1, wherein said power input terminal has a fuse to protect said central control device from being damaged by an over current.

* * * * *